US011950667B2

(12) United States Patent
Drake

(10) Patent No.: US 11,950,667 B2
(45) Date of Patent: Apr. 9, 2024

(54) PURSE WITH INTEGRATED REMOVABLE PHONE CASE

(71) Applicant: Karis and Drake, LLC, Los Angeles, CA (US)

(72) Inventor: Maggie Drake, Los Angeles, CA (US)

(73) Assignee: Karis and Drake, LLC, Los Angeles, CA (US)

( * ) Notice: Subject to any disclaimer, the term of this patent is extended or adjusted under 35 U.S.C. 154(b) by 0 days.

(21) Appl. No.: 17/033,085

(22) Filed: Sep. 25, 2020

(65) Prior Publication Data

US 2022/0087385 A1 Mar. 24, 2022

Related U.S. Application Data

(60) Provisional application No. 62/905,826, filed on Sep. 25, 2019.

(51) Int. Cl.

| | |
|---|---|
| ***A45C 11/00*** | (2006.01) |
| ***A45C 3/06*** | (2006.01) |
| ***A45C 13/30*** | (2006.01) |

(52) U.S. Cl.

CPC ..... *A45C 11/00* (2013.01); *A45C 3/06* (2013.01); *A45C 13/30* (2013.01); *A45C 2011/002* (2013.01); *A45C 2013/306* (2013.01)

(58) Field of Classification Search

CPC ..... A45C 2013/306; A45C 11/00; A45C 3/06; A45C 13/30; A45C 2011/002

See application file for complete search history.

(56) References Cited

U.S. PATENT DOCUMENTS 4,154,275 A * 5/1979 Cauley ..... A45C 15/00 150/123
5,354,131 A * 10/1994 Mogil ..... A45C 13/26 383/110
5,713,439 A * 2/1998 Zionts ..... A45C 5/14 150/108

(Continued)

FOREIGN PATENT DOCUMENTS

KR 20130007097 U * 6/2012
KR 20160002080 U * 6/2016

OTHER PUBLICATIONS

Beaulegan: (https://www.amazon.com/dp/B07D8T8LN7) (Year: 2018).*

(Continued)

*Primary Examiner* — Don M Anderson
*Assistant Examiner* — Justin Caudill
(74) *Attorney, Agent, or Firm* — K&L Gates LLP

(57) ABSTRACT

A purse with an integrated and removable phone case includes an attached, but removable, phone case suspended from a purse strap by a chain, cord, or similar mechanism. Cell phone users require immediate, unencumbered access to their phones. Currently available products require the phone user to remove his or her phone from a bag. Phone cases cannot hold many items without becoming too bulky. Small purses have limited storage space and personal devices can take up much of that space. Moreover, carrying a phone case with a strap in addition to a purse with a strap can cause tangling and limit ease of use. An externally available phone case suspended from a strap of a purse allows for immediate access to the cell phone without consuming space within the purse. The suspended phone case may be removed from the purse to allow for separate use of the phone or purse.

13 Claims, 7 Drawing Sheets

(56) References Cited

U.S. PATENT DOCUMENTS 5,816,460 A * 10/1998 Cook ..... A45F 3/14 224/604
6,123,240 A * 9/2000 Fowles ..... A45C 1/04 224/600
D499,546 S * 12/2004 Smithers ..... D3/218
D533,994 S * 12/2006 Hussaini ..... D3/218
D547,055 S * 7/2007 Ballman ..... D3/218
D631,650 S * 2/2011 Li ..... D3/218
9,154,591 B1 * 10/2015 Patterson ..... H04M 1/23
D803,207 S * 11/2017 Karis ..... D14/250
9,872,553 B1 * 1/2018 Erlandson ..... A45F 3/00
D840,678 S * 2/2019 Mouriz ..... D3/218
D851,927 S * 6/2019 Ormsby ..... D3/246
2003/0230368 A1 * 12/2003 Cazes ..... A45C 1/024 150/113
2005/0115848 A1 * 6/2005 Tauchen ..... A45C 3/00 206/315.1
2005/0127123 A1 * 6/2005 Smithers ..... A45F 5/00 224/610
2008/0060972 A1 * 3/2008 Rappaport ..... A45C 15/00 383/117
2009/0023484 A1 * 1/2009 Macklin ..... A45C 11/00 455/575.6
2010/0307878 A1 * 12/2010 Giglio ..... A45C 7/0086 190/100
2013/0190053 A1 * 7/2013 Kelly ..... A45C 5/06 455/566
2013/0206527 A1 * 8/2013 Von Furstenberg ..... A45C 3/02 53/472
2013/0270312 A1 * 10/2013 Yun ..... A45F 5/00 224/268
2018/0140063 A1 * 5/2018 Gomez ..... A45F 5/021
2019/0053593 A1 * 2/2019 Kosowicz ..... A45C 11/04
2019/0298044 A1 * 10/2019 Frank ..... A45F 5/00

OTHER PUBLICATIONS

Black Lemon: (https://www.amazon.com/Black-Lemon-iPhone-Silicone-Shockproof/dp/B01M3RDOSE/) (Year: 2016).*

* cited by examiner

PURSE WITH INTEGRATED REMOVABLE PHONE CASE

PRIORITY CLAIM

This application is a non-provisional of, and claims priority to and the benefit of, U.S. Provisional Application No. 62/905,826, filed on Sep. 25, 2019, the contents of which are incorporated herein by reference.

BACKGROUND

Purses and cell phone cases currently exist as separate consumer products. When a person wants to place his or her cell phone inside his or her bag or purse, he or she must limit additional items placed inside of the bag or purse to make room for the phone to fit. Additionally, current phone cases and purses on the market require the user to physically remove the phone from the purse when a notification, phone call, or other message is received. This additional step of removing the phone from the purse is inconvenient because it takes time. This is also a hassle for individuals who are on the move or are whose hands are occupied. Having one's cell phone externally available outside the purse, while still safely attached to the purse, allows for immediate and easy access to the cell phone.

Nowadays, phone users are limited to the following basic options: (1) carrying the phone by hand; (2) carrying the phone inside a purse or pocket; or (3) carrying the phone by way of a strap. Each of these currently available options has its own downsides. With respect to the first option, the downside to the user is that the user's hand is occupied by the phone, which prevents the user from freely using at least one of his or her hands. It is also easier to drop the phone when it is not otherwise attached to a hand or to the individual user's body. With respect to the second option, the downside to the user is that limited space within a purse is occupied by the phone and it may be uncomfortable to the user to carry a phone in a pocket. When the phone is tucked away in a pocket or purse, the screen is not visible and therefore, the phone must be removed from the pocket or purse to be used. And as for the third option, which is a design attributable to the assignee of the instant application and is described, for example, in U.S. Design Pat. No. D762,632, the entirety of which is incorporated herein by reference, the downside to the user is that the user does not have any space to carry items beyond what can be stored within the phone case itself or in pockets. To the extent a user carries both a purse with a strap and a phone with a strap, these often get tangled and make use of each less practical and removal of each difficult.

The instant application solves these and other problems with current cellular phone (or other personal electronic device) carrying options.

SUMMARY

The apparatus disclosed herein remedies the above-described problems by providing a convenient carrying solution in which a cell phone (or other electronic device) can be carried alongside a bag, purse, or other appropriate vessel. In embodiments of the system disclosed herein, the electronic device is attached to a strap, and the bag, purse, or other vessel is also attached to a strap, such that either component of the disclosed apparatus is readily accessible as needed.

In embodiments of the disclosed apparatus, the strap to which the cell phone is connected permits a user to separately pick up, use, and otherwise engage with the cell phone while the purse, bag, or other storage vessel remains at the side of the user of the apparatus. In some such embodiments, a separate chain is used to attach the electronic device to the bag; the chain is detachable, such that if desired the user can remove the electronic device from the overall bag to enable usage as a standard cell phone.

In some embodiments, the disclosed apparatus beneficially permits a user to securely carry an electronic device (such as a cell phone) that is easily accessible during day-to-day life, but that is nevertheless carryable hands-free, without fear that the electronic device will be stolen or otherwise misplaced. In some embodiments, the apparatus disclosed herein therefore permits a user to carry personal items (e.g., a wallet, cosmetics, and the like) while also carrying a cellular phone but while not occupying valuable bag space for that cellular device. In these embodiments, the personal items are all nonetheless secured during carrying.

DETAILED DESCRIPTION

Figure 1:
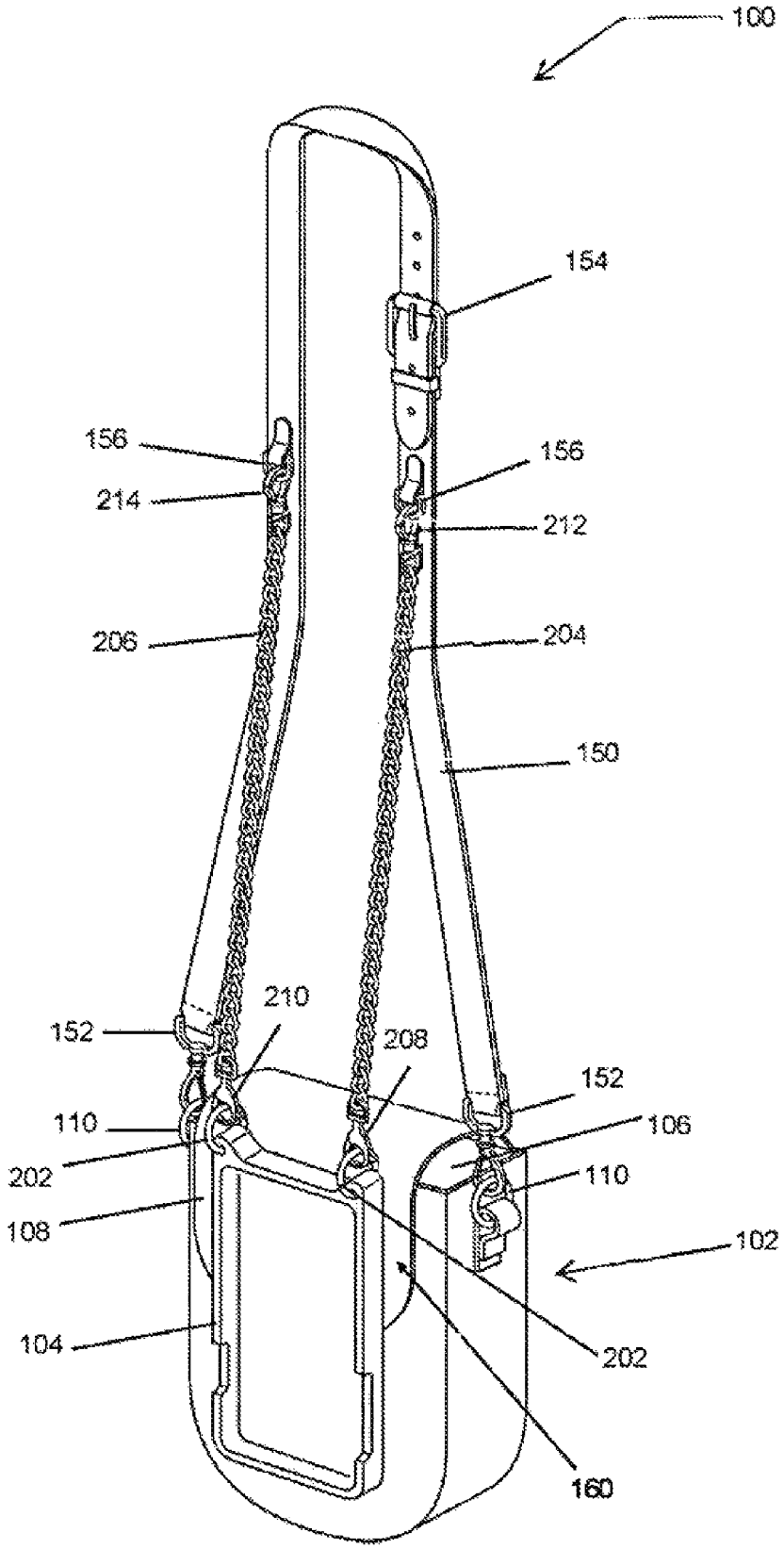
FIG. 1 is a perspective view of an exemplary embodiment of the apparatus disclosed herein.
Figure 2:
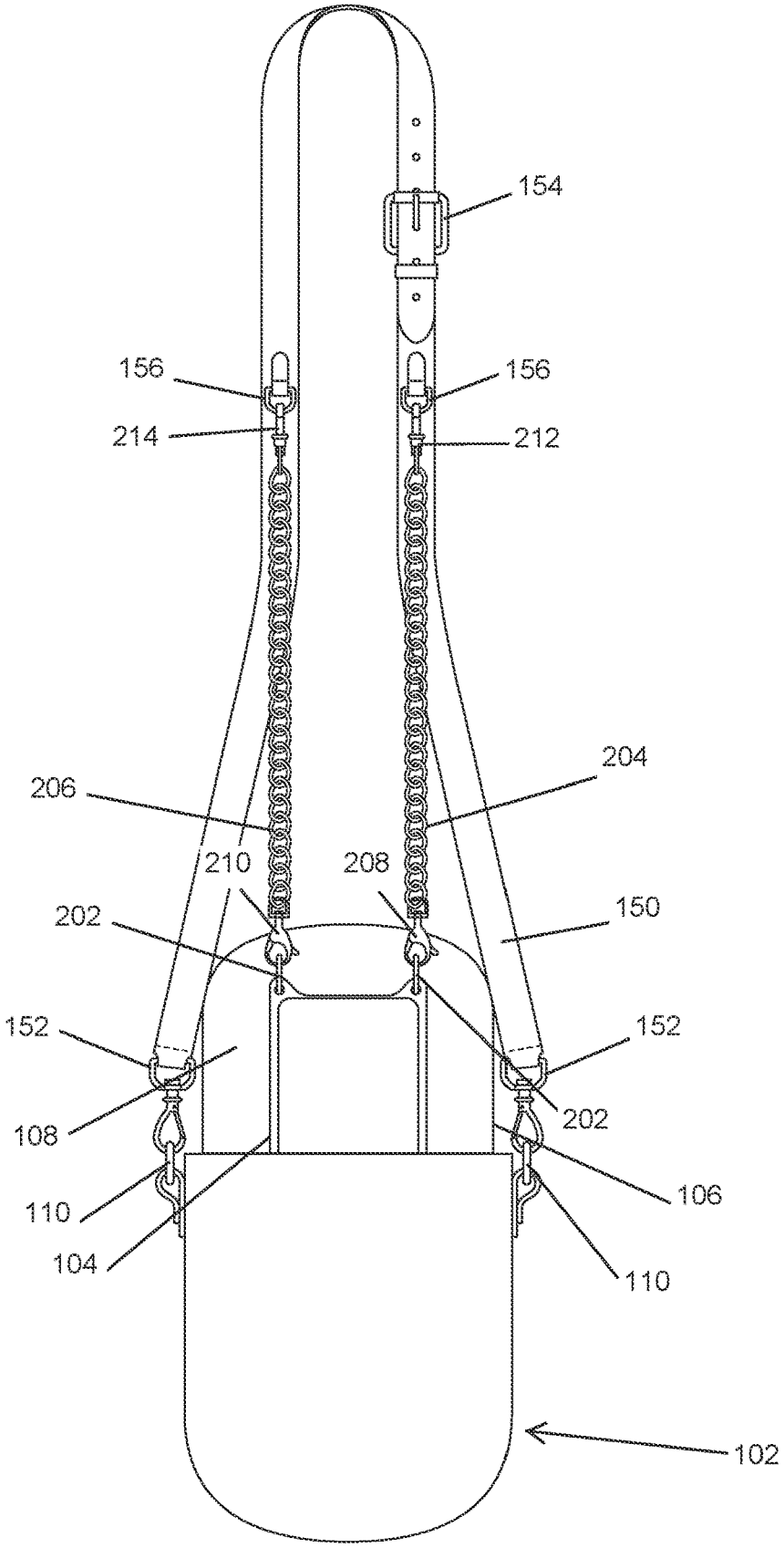
FIG. 2 is a front view of an exemplary embodiment of the apparatus disclosed herein.

Embodiments of the apparatus disclosed herein solve the above-described problems by providing a combination carrying solution that includes a primary carrying component configured to hold personal items, such as cosmetics, credit cards, money, and the like, and a secondary carrying component configured to hold one or more personal electronic devices. In these embodiments, the primary carrying component includes a strap, belt, or other mechanism by which a user can secure the primary carrying element to his or her body. Also in these embodiments, the secondary carrying component is sized and shaped to securely hold a personal electronic device, such as a cell phone or tablet computer, within a protective case or shell. In these embodiments, the secondary carrying component also includes one or more mechanical members (such as grommets, holes, or clips) that can be affixed to one or more straps, chains, or cords. The attached straps, cords, or chains are configured to connect to one or more mechanical members of the primary carrying component, such that when the primary carrying component is being carried by a user, the secondary carrying component (affixed to the primary carrying component) is also carried, albeit indirectly, by the user. In various embodiments, the described attached straps, cords, or chains can be combined but do not need to be. Also in some embodiments, the straps are interchangeable so that the purse and phone can be worn together or separately at varying lengths and styles, as desired by the wearer. In some embodiments, in addition to straps, cords, or chains, the disclosed apparatus and its various connection components may be plastic cords, bungee cords, lanyards, or other suitable connection apparatuses.

In various embodiments, the straps, cords, or chains are sized such that the secondary carrying component hangs at approximately the same height as the primary carrying component. In some embodiments, the disclosed apparatus permits the user to either carry the secondary carrying component on the inside of the primary carrying component, making it inaccessible to passersby (by virtue of being invisible from the outside). In some embodiments, similar sizing of the straps, cords, or chains means that the user may alternatively carry the apparatus such that the secondary carrying component is exterior outside the primary carrying component with regard to the user's body. In these embodiments, the apparatus permits the wearer to easily access his or her personal electronic device at a glance, while not needing to open or otherwise access the primary carrying component.

In some embodiments, the straps, cords, or chains are configured for easy removal from the primary carrying component, the secondary carrying component, or both. For example, in one embodiment the straps, cords, or chains are configured with easy-release clasps for connection to one or more hooks or eyelets on the primary carrying component. In this embodiment, the apparatus permits a user to easily remove the second carrying component (and the attached straps, cords, or chains) from the primary carrying component if, for example, the wearer only needs his or her personal electronic device. In a further embodiment, the straps, cords, or chains are of an appropriate length that the easy-release clasps can be connected to one another, such that the secondary carrying component can be worn around the wearer's shoulder in the event the wearer still desires a hands-free carrying apparatus. This arrangement also permits the wearer to match one primary carrying component with one or more different secondary carrying components, which may be sold together in pairs or separately, as desired.

In various embodiments of the system disclosed herein, one or more features of the primary carrying component is sized and configured to permit wearer insertion of the secondary carrying component into the primary carrying component. In one such embodiment, the primary carrying component includes a pocket or pouch on an external surface into which the user can insert the secondary carrying component. In this embodiment, if the user wishes slightly more security for his or her personal electronic device (without opening a primary opening mechanism of the primary carrying component), the apparatus permits the user to insert the secondary carrying component into the pocket or pouch for easy retrieval.

In another such embodiment, the disclosed primary carrying component has a closure mechanism covering the storage area, such as a flap, a zippered closure, a button/snap enclosure, or some other kind of closure mechanism. These mechanisms permit the wearer to secure the contents of the primary carrying component. In this embodiment, the flap or zippered closure secures the contents of the primary carrying component because a person wishing to surreptitiously access the contents would need to open a flap or unzip a zipper, for example. In such an embodiment, the apparatus disclosed herein includes a slot or other opening that is relatively smaller than the closure mechanism over the primary storage area but nonetheless sized to receive the secondary carrying component. For example, the other opening may be a slot dimensioned to receive the secondary carrying component without permitting a human hand to easily enter the primary carrying component. Nonetheless, a wearer may insert the secondary carrying component in the other opening, which provides an additional degree of security beyond the secondary component being attached via strap, cord, or chain to the primary carrying component. While this embodiment may provide somewhat more difficulty for the user desiring to withdraw his or her personal electronic device from the primary carrying component, it provides additional security against a third party attempting to do the same without the wearer's knowledge.

In one embodiment, the disclosed apparatus includes only the secondary storage component, the straps, cords, or chains, and a primary component strap such as a purse strap. In this embodiment, the purse strap includes one or more attachment mechanisms (e.g., clips or eyelets) to which the straps, cords, or chains can be attached. It will be appreciated that this arrangement permits the disclosed apparatus to be used in connection with an existing primary storage component (e.g., a wearer's favorite purse) and nonetheless to permit the secondary storage component to hang from the purse strap at an appropriate height with respect to the existing primary storage component.

In one embodiment, the disclosed apparatus combines a first (shorter) strap, cord, or chain with two longer straps, cords, or chains to achieve different materials at the portion of the apparatus that contacts the wearer's body. For example, a shorter, leather portion may be connected between a pair of longer chain sections such that the leather section contacts the wearer's body, while the longer chain sections provide support for the carrying apparatus. In this embodiment, the disclosed apparatus provides the added benefit of reducing discomfort from a chain contacting a wearer's shoulder, but retains the sturdiness of chains for part of the strap.

Referring now to FIGS. 1 to 7, an exemplary embodiment of the apparatus disclosed herein is illustrated, with like numerals referring to the same components from different perspectives.

Figure 3:
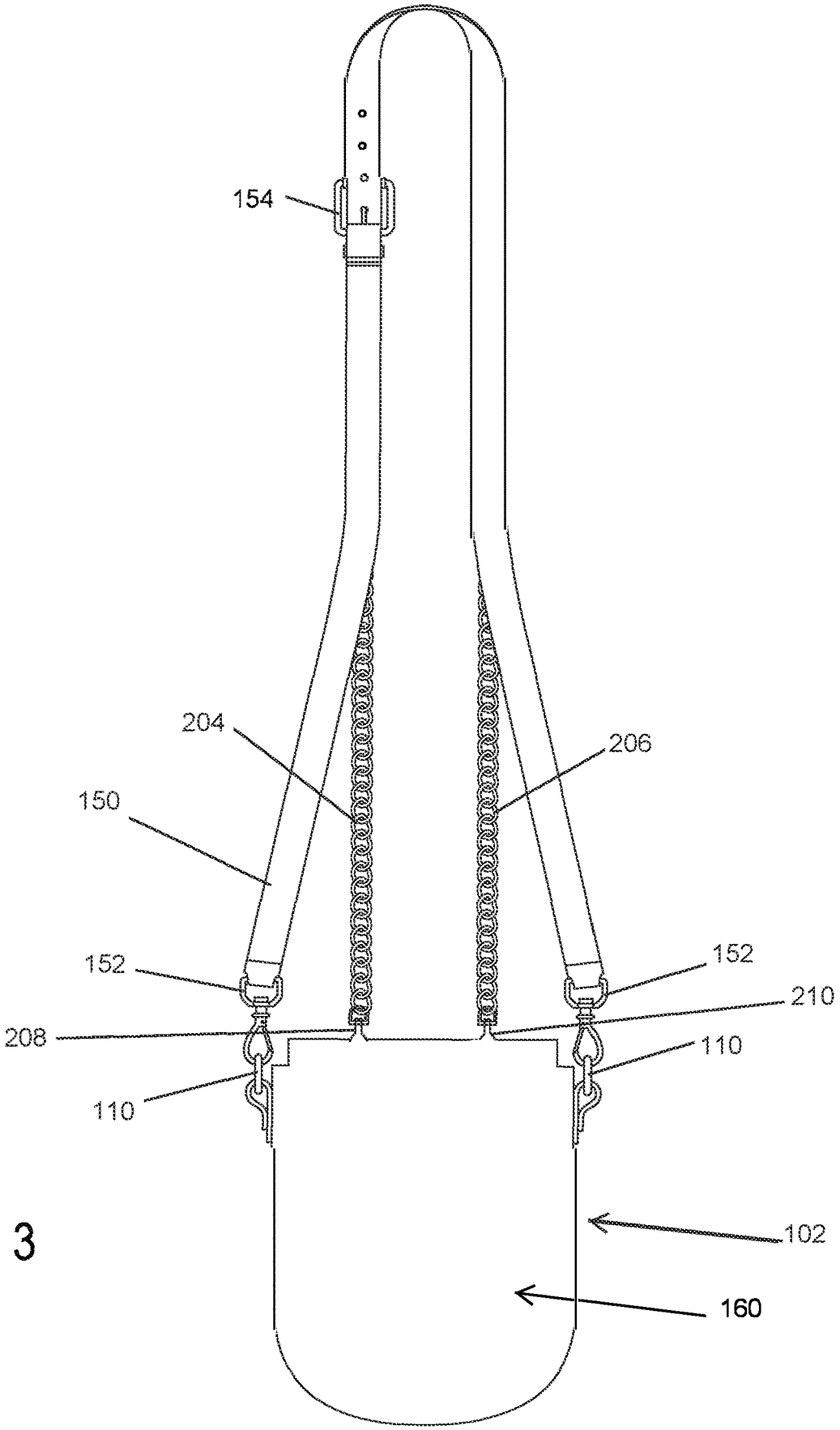
FIG. 3 is a back view of an exemplary embodiment of the apparatus disclosed herein.
Figure 4:
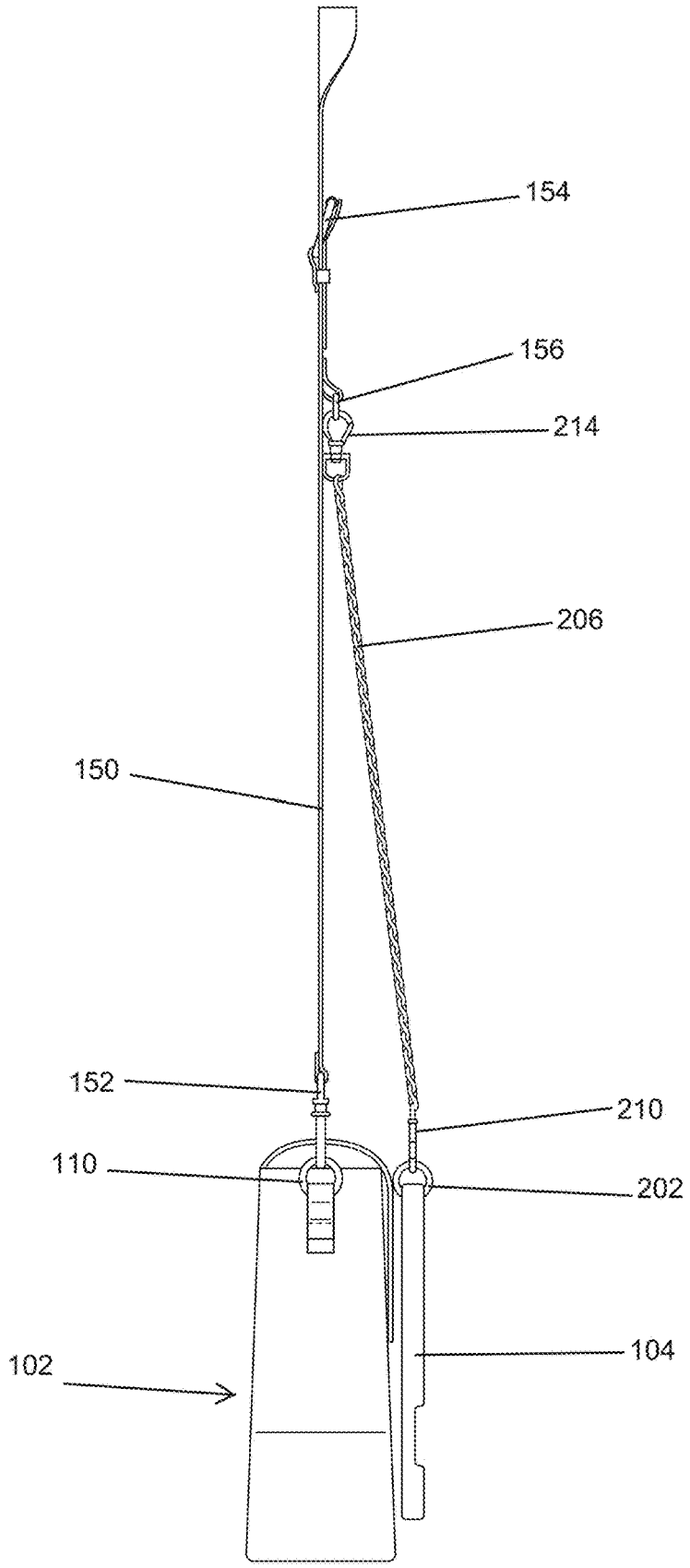
FIG. 4 is a side view of an exemplary embodiment of the apparatus disclosed herein.
Figure 5:
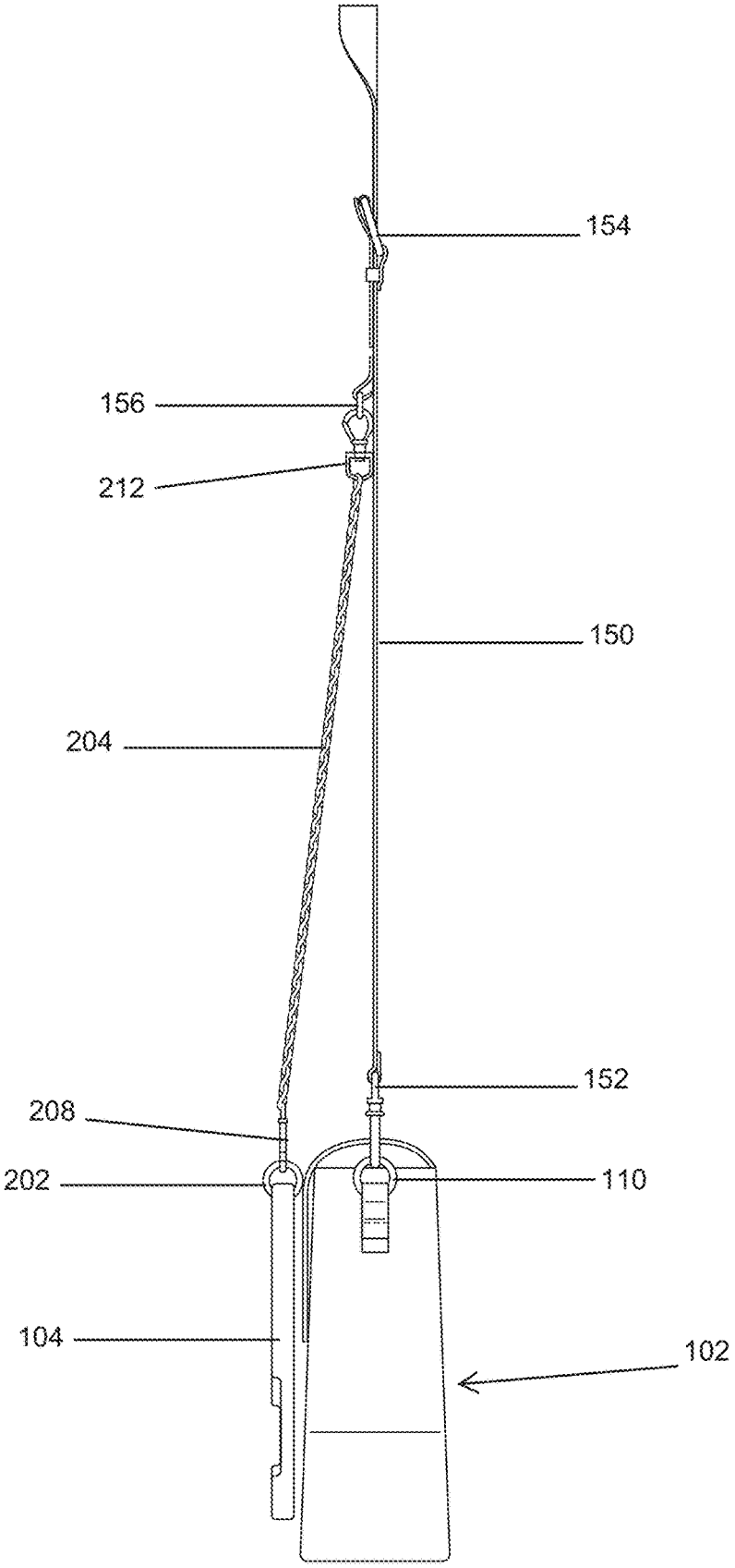
FIG. 5 is a side view of an exemplary embodiment of the apparatus disclosed herein.
Figure 6:
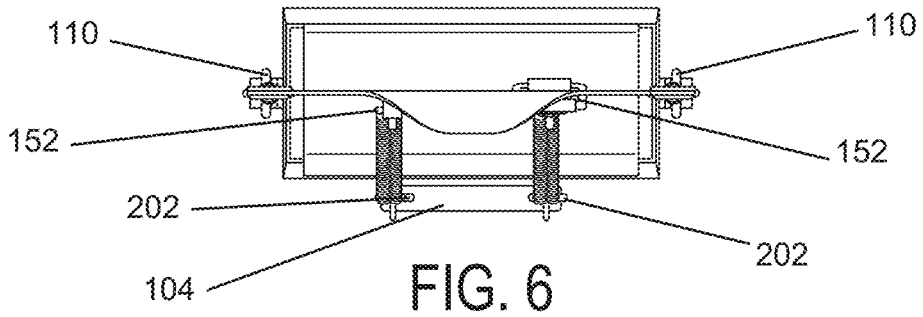
FIG. 6 is a top view of an exemplary embodiment of the apparatus disclosed herein.
Figure 7:
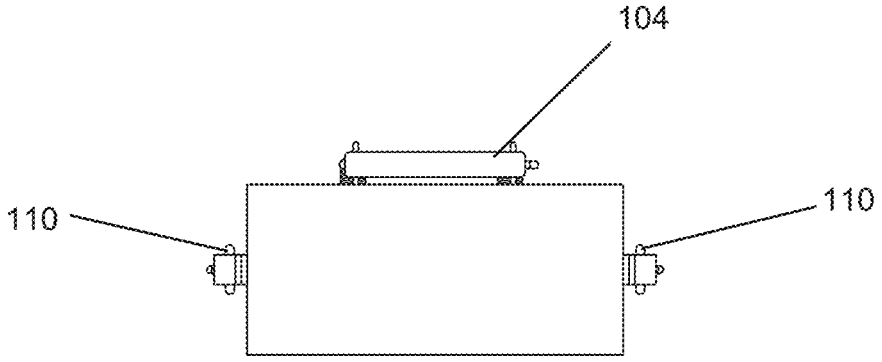
FIG. 7 is a bottom view of an exemplary embodiment of the apparatus disclosed herein.

In the illustrated embodiment, the disclosed carrying apparatus 100 includes a primary carrying component 102 (e.g., a purse) and a secondary carrying component 104 (e.g., a cell phone case). In this embodiment, the primary carrying component 102 includes a cavity 106 for carrying items, such as cash, credit cards, cosmetics, identification, keys, and the like. Additionally, as illustrated in FIGS. 1 and 3, the primary carrying component 102 includes an exterior pocket 160 configured to hold the secondary carrying component 104. Also in this embodiment, the primary carrying component 102 includes a flap 108 configured to cover the cavity 106 to prevent easy access by unauthorized individuals. This flap 108 may be secured, for example, by a snap, button, zipper, or other closure mechanism (e.g., Velcro® or other such hook and loop fasteners). Also in this embodiment, illustrated in FIG. 2, the hollow cavity, covered by said flap 108, is configured to receive the personal electronic device case 104.

In the illustrated embodiment, the primary carrying component 102 also includes a removable strap 150 that includes two clasps or clips 152 that permit attachment and removal from one or more rings or other apparatus 110 of the primary carrying component 102. The strap 150 in the illustrated embodiment is adjustable by way of buckle 154 to permit the wearer to adjust the height of the primary carrying component 102 while being worn. In the illustrated embodiment, the strap 150 also includes two connection points 156 that include, in the illustrated embodiment, rings to permit attachment of a secondary carrying component 104 (described in more detail below). In various embodiments, the connection points include other apparatus besides rings, such as clips, flaps, clasps, Velcro, or other mechanisms to permit attachment of the secondary carrying component 104.

In the illustrated embodiment, the secondary carrying component 104 includes a pair of connection points 202 that permit a pair of chains 204, 206 to connect to the secondary carrying component 104. In the illustrated embodiment the connection points 202 include grommets and rings (D-rings, O-rings, or otherwise) to which chains 204 and 206 can connect by way of clips 208, 210. In this embodiment, it should be appreciated that the chains 204, 206 can be detached from secondary carrying component 104 by virtue of clips 208 and 210. In particular, in the illustrated embodiment, the connection mechanism provides a benefit that the secondary carrying component can be readily detached, while in other embodiments, different connection mechanisms (permanent or impermanent) can be used to connect chains 204, 206 to secondary carrying component 104.

In the illustrated embodiment, secondary carrying component 104 is sized and shaped to engage a user's personal electronic device, such as a smart phone, tablet computer, camera, or the like. In some embodiments, this engagement is a tight, protective engagement such as a "skin" type carrying case. In other embodiments, the secondary carrying component is a pouch, bag, or other vessel for securing a personal electronic device within the secondary carrying component.

In the illustrated embodiment, chains 204 and 206 also include clips 212 and 214 that permit the chains to removably connect to the connection points 156 such that the combination of the secondary carrying component 104 and the chains 204 and 206 can be readily removed from the strap 150 if the wearer wishes to either change the secondary carrying component 104 or otherwise separate the secondary carrying component 104 from the primary carrying component 102. In the illustrated embodiment, chains 204 and 206 are sized such that the secondary carrying component hangs at the same height as the primary carrying component. In other embodiments, chains 204 and 206 may be adjustable, such that the height of the secondary carrying component relative to the primary carrying component can be adjusted. In still other embodiments, straps or other more readily adjustable devices are used instead of chains 204 and 206 where ease of adjustability is desired. In some embodiments, these straps are of varying lengths so that when worn separately they can be worn at different lengths as desired by the wearer.

In the illustrated embodiment, clips 212 and 214 can be connected together such that the secondary carrying component 104 can become a standalone carrying device, wearable by the wearer. For example, clips 212 and 214 can connect to each other such that a wearer may wear the secondary carrying component 104 around his or her shoulder separated from the primary carrying component 102.

Figure 8:
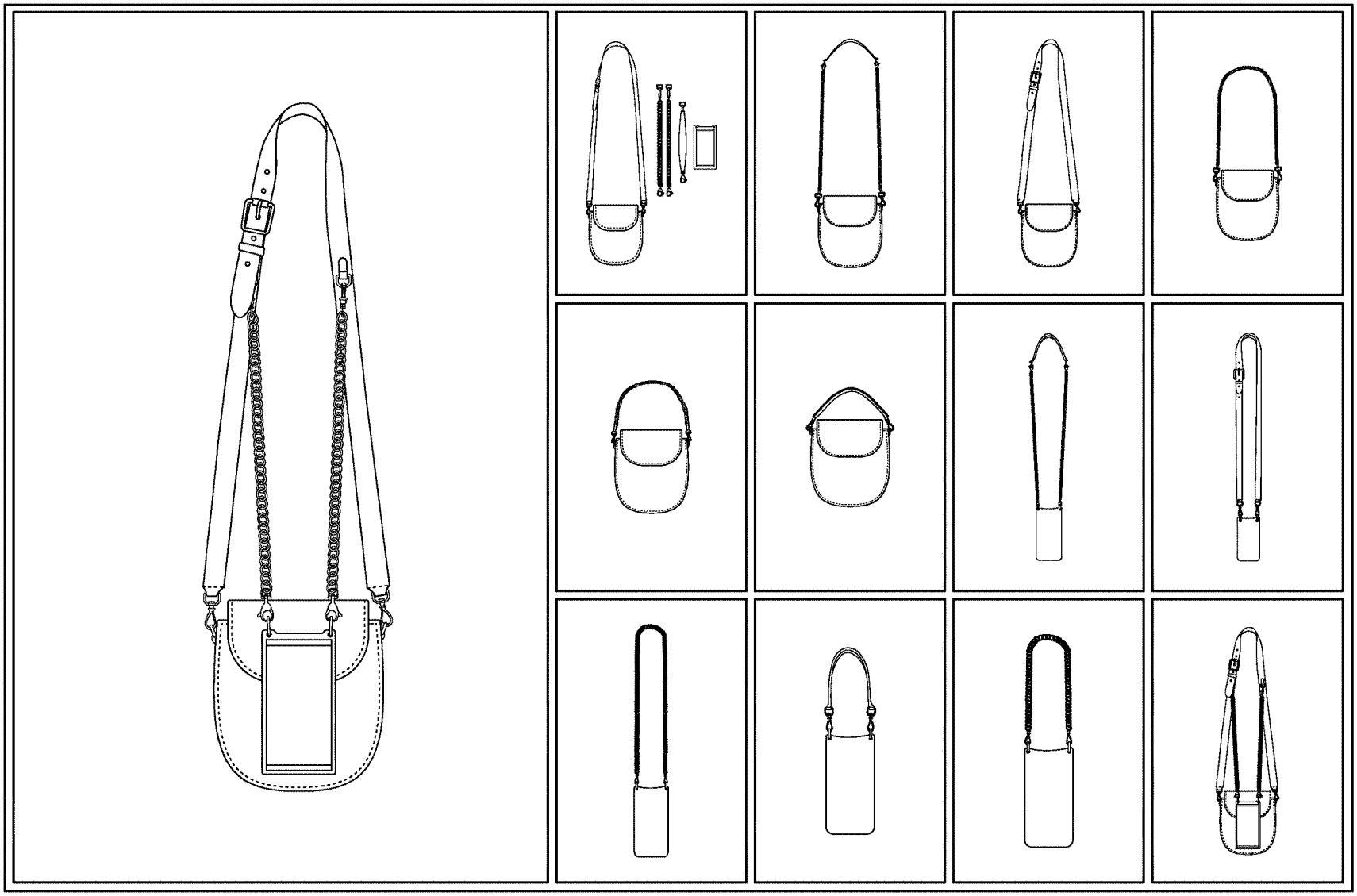
FIG. 8 is an illustration of a plurality of different embodiments of the apparatus disclosed herein.

FIG. 8 illustrates a plurality of different embodiments of the apparatus disclosed and claimed herein. It should be appreciated that the further illustrations of embodiments in FIG. 8 is not limiting, but rather indicative of the scope of embodiments that are contemplated herein and the different variations that can be achieved in, for example, carrying apparatus, connection apparatus, wearing style, and device security.

It will be appreciated that the apparatus and components described above provide several distinct advantages over the prior art solutions described above. First, wearers need not open up the primary cavity, which might contain potentially more valuable spaces (e.g., spaces carrying credit cards, currency, identification, jewelry, and the like) but may still easily access a personal electronic device to, for example, send text messages or take photographs. It will be appreciated that in some embodiments, an apparatus providing ready access to a phone or other personal electronic device beneficially permits the user to access (and thus use) that device more quickly but also prevents theft/loss as it is still attached securely to the wearer. Advantageously, embodiments of the apparatus disclosed herein do not require the wearer to open up a purse to potentially give access to the contents in the purse. Thus, embodiments of the disclosed apparatus provide security for personal electronic devices, but permit the wearer to access the device to, for example, take a perfect photo quickly if, for example, the sun is setting.

Second, the disclosed apparatus permits the wearer to detach the personal device carrying component from the primary carrying component when appropriate, such as if the wearer wishes to leave the primary carrying component at a bag check or other storage area while still desiring access to the personal electronic device. Third, in embodiments where the primary carrying component includes a slot or other pocket sized and configured to hold the secondary carrying component, the disclosed apparatus permits the wearer to further secure his or her personal electronic device by storing the device (and the attached secondary carrying component) within the primary carrying component. In these embodiments, the device is still readily accessible, and does not require opening the primary carrying component, but provides an additional level of security.

It should be understood that various changes and modifications to the examples described here will be apparent to those skilled in the art. Such changes and modifications can be made without departing from the spirit and scope of the present subject matter and without diminishing its intended advantages. It is therefore intended that such changes and modifications be covered by the appended claims.

I claim:

1. A purse with an integrated removable carrying case for a personal electronic device, the purse comprising:

a purse body including a hollow cavity for storing items;

a purse strap attached to the purse body, said purse strap including two suspension eyelets which are positioned at a predetermined distance from each other along the purse strap;

a personal electronic device case including a corner eyelet in each of two corners of an upper-most, narrow end of the case when the case is positioned for use;

a personal electronic device anterior chain attached to a first one of said corner eyelets and attached to one of said suspension eyelets on the purse strap; and a personal electronic device posterior chain attached to a second one of said corner eyelets and attached to one of said suspension eyelets on the purse strap, the personal electronic device posterior chain positioned to be parallel to the personal electronic device anterior chain along at least a portion of the purse strap, wherein the purse body further comprises a flap covering said hollow cavity, said flap including a slot sized to receive the personal electronic device case.

2. The purse of claim 1, wherein the purse body includes an exterior pocket configured to hold said personal electronic device carrying case.

3. The purse of claim 1, wherein at least one of the anterior chain and the posterior chain is at least one material selected from the group consisting of: a metal chain, a nylon strap, a leather strap, and a fabric strap.

4. The purse of claim 3, wherein the material includes at least two selected from the group consisting of: a metal chain, a nylon strap, a leather strap, and a fabric strap.

5. A purse configured to carry a suspended personal electronic device case, the purse comprising:

a purse body including a hollow cavity for storing items;

a personal electronic device carrying case, wherein the purse body further comprises a flap covering said hollow cavity, said flap including a slot sized to receive the personal electronic device case; and a purse strap attached to the purse body, said purse strap including two suspension eyelets which are positioned at a predetermined distance from each other along the purse strap, wherein a first suspension eyelet is configured to be attached to a personal electronic device anterior chain attached to a first corner of an upper-most, narrow end of a personal electronic device carrying case when the carrying case is positioned for use, wherein a second suspension eyelet is configured to be attached to a personal electronic device posterior chain attached to a different, second corner of the upper-most, narrow end of a personal electronic device carrying case and wherein the personal electronic device posterior chain is positioned to be parallel to the personal electronic device anterior chain along at least a portion of the purse strap.

6. The purse of claim 5, further comprising the personal electronic device carrying case.

7. The purse of claim 5, wherein the purse body includes an exterior pocket configured to hold said personal electronic device carrying case.

8. The purse of claim 5, including said anterior chain and said posterior chain, and wherein at least one of the anterior chain and the posterior chain is at least one material selected from the group consisting of: a metal chain, a nylon strap, a leather strap, and a fabric strap.

9. The purse of claim 8, wherein the material includes at least two selected from the group consisting of: a metal chain, a nylon strap, a leather strap, and a fabric strap.

10. A personal electronic device carrying apparatus comprising:

a strap including a plurality of suspension eyelets;

a personal electronic device case body including a corner eyelet in each of two corners of an upper-most, narrow end of the case when the case is positioned for use;

a personal electronic device anterior chain attached to a first one of said corner eyelets and configured to be attached to one of the plurality of suspension eyelets on the strap; and a personal electronic device posterior chain attached to a second one of said corner eyelets and configured to be attached to a different one of said plurality of suspension eyelets on the strap, the personal electronic device posterior chain positioned to be parallel to the personal electronic device anterior chain along at least a portion of the strap, wherein the personal electronic device carrying case is further configured to be insertable in a slot of a flap of the carrying apparatus, said flap covering a hollow cavity of said carrying apparatus.

11. The personal electronic device carrying case of claim 10, which is further configured to have dimensions comparably smaller than an exterior pocket of a carrying apparatus allowing the personal electronic device carrying case to be insertable in the exterior pocket of the carrying apparatus.

12. The personal electronic device carrying case of claim 10, wherein at least one of the anterior chain and the posterior chain is at least one material selected from the group consisting of: a metal chain, a nylon strap, a leather strap, and a fabric strap.

13. The personal electronic device carrying case of claim 12, wherein the material includes at least two selected from the group consisting of: a metal chain, a nylon strap, a leather strap, and a fabric strap.

* * * * *